US005857892A

United States Patent [19]

Leadbetter

[11] Patent Number: 5,857,892

[45] **Date of Patent: *Jan. 12, 1999**

[54] TOY ELEMENT

[75] Inventor: Paul Leadbetter, Holbaek, Denmark

[73] Assignee: INTERLEGO AG, Baar, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 714,854

[22] Filed: Sep. 17, 1996

[51] Int. Cl.[6] ..... A63H 33/00

[52] U.S. Cl. ..... 446/431; 446/437; 446/489

[58] Field of Search ..... 446/431, 489, 446/418, 419, 310, 368, 320, 321, 330, 437, 441; 273/138.1, 146; 473/594, 595, 614, 163, 167

[56] References Cited

U.S. PATENT DOCUMENTS

| | | | |
|---|---|---|---|
| 99,023 | 1/1870 | Splitdorf | 446/310 |
| 581,302 | 4/1897 | Patrick | 446/310 |
| 3,106,397 | 10/1963 | Lacey . | |
| 3,262,700 | 7/1966 | Miller | 473/594 |
| 3,827,162 | 8/1974 | Moeser . | |
| 4,170,106 | 10/1979 | Koslosky | 446/418 X |
| 4,282,679 | 8/1981 | Grubb et al. | 446/419 |
| 5,046,983 | 9/1991 | Suzuki | 446/368 X |
| 5,507,678 | 4/1996 | Chiang | 446/390 X |
| 5,727,947 | 3/1998 | Esterle | 434/258 |

*Primary Examiner*—Kien T. Nguyen
*Assistant Examiner*—Jeffrey D. Carlson
*Attorney, Agent, or Firm*—Kane,Dalsimer,Sullivan, Kurucz, Levy, Eisele and Richard, LLP

[57] ABSTRACT

A toy element composed of a rolling body having a body surface, with at least four apertures provided in the body surface, and at least two movable members. Each of the members consists of a first and a second oppositely arranged element interconnected by a rigid rod. The first and second elements are aligned with the apertures of the body surface. Each of the members is movable within the rolling body between a first position where the first element is significantly protruding from the rolling body surface while the second element is less protruding from the rolling body surface, and a second position where the second element is substantially protruding from the rolling body surface while the first element is less protruding from the rolling body surface. Each member has a center line, and the center lines of all of the members intersect at a common intersection point. The rods connecting the elements in pairs to form the members are, at least in an area around the intersection point, positioned apart from the center lines.

8 Claims, 3 Drawing Sheets

TOY ELEMENT

BACKGROUND ON THE INVENTION

1. Field of the Invention

The present invention relates to a toy element comprising a rolling body, the surface of which is provided with at least four apertures wherein moveable elements are provided which is displaceable relative to the rolling body, said element being capable of moving between an outermost, first position where it is significantly protruding from the surface of the rolling body, and an innermost, second position where it is less protruding from the surface of the rolling body compared to the first position.

2. Description of the Prior Art

Such toy element is known i.a. from U.S. Pat. No. 3,106,397 which discloses a ball with radially extending elements. The elements may be pressed home so as to substantially level with the ball surface while simultaneously activating a spring means. Moreover each element is provided with a centrally arranged expulsion means which expels the pressed-home element when activated by an inwardly oriented force. During play with this ball, all its elements are pressed home to make them spring-biased, whereupon the ball is rolled across a surface, e.g. a floor. When an expulsion means strikes the floor, it is pressed inwards whereby the associated member is expelled from the ball surface. Hereby the ball is pushed in a random direction, which may be repeated until all elements have been released.

The ball described above has a fairly complex structure and comprises many components, each element being provided with spring means, latching means and expulsion means.

Moreover, it bounces randomly from one place to another and may rapidly end up far away from the child playing therewith.

DE-A1-3,043,663 discloses a hollow toy ball with three large apertures, the interior of said ball being provided with a large toy element which may optionally be provided with movable parts and which may partially protrude through the openings of said ball.

Primarily, this toy ball is suitable for use as a rattle, since the child may seize the interior toy element through the apertures of the ball and when the ball is shaken, the sound liked by children is produced.

U.S. Pat. No. 581,302 discloses a toy ball having a movable member which alternatively can protrude from diametrically opposed sides of the toy ball. The movable member consists of a rigid rod connecting two rubber or wooded heads which alternatively pop up when the ball rolls across a floor.

It is the object of the present invention to provide a toy element which increases the thrill experienced by the child when rolling the toy across a surface, e.g. a floor, while simultaneously slowing it down to prevent it from rolling too far away from the child who is playing with it.

SUMMARY OF THE INVENTION

This object is obtained by devising a toy element as comprising a rolling body, at least four apertures in the body and at least two members, each consisting of oppositely arrange elements interconnected by a rod and slidably movable within the apertures such that one of the elements alternatively protrudes from the surface of the body a greater distance that the other of the elements.

Hereby a toy element in the form of a rolling body having two or more movable members with a common intersection point, and which, when rolled across a surface, bounces irregularly, as it changes direction when the radially extending elements are struck. Simultaneously, the resistance to displacement of the protruding elements causes the toy element to be slowed down whereby it is prevented from rolling far away.

By devising the movable elements to be freely displaceable in the rolling body to ensure that their movement is exclusively caused by the movement of the rolling body and the influence of gravity, a particularly simple construction of the toy element according to the invention is obtained.

Preferably the rolling body is spherical, since this particular shape further inspires the child to roll the toy element.

According to a particularly preferred embodiment of the invention, six radially movable elements are arranged in pairs diametrically opposite the spherical rolling body, and the diametrically oppositely arranged, radially movable elements are rigidly connected to each other. By devising the toy element in this manner it is obtained that the element which faces upwards is expelled from the ball when it rolls over the element that faces downwards. Hereby rolling of the ball causes the elements to be displaced alternatingly inwards and outwards on the side that faces upwards as well as the one that faces downwards. Hereby the thrill experienced by the child when playing with the toy element is significantly enhanced.

Instead of loosely embedded elements, spring-biased elements may be used to make them assume their protruding positions in their unbiased state. However, the springs used must be adjusted in accordance with the weight of the toy element whereby the elements are impelled when the toy element rolls over them.

Preferably the rods and/or elements are provided with spacer parts which may engage with the rod of the intersecting movable members to restrict the displacement of the movable members. In this manner it is ensured that the movable member may only be displaced a predetermined distance.

According to a preferred embodiment wherein the toy element is a spherical body, the toy element comprises three movable members arranged perpendicularly relative to each other whereby the ball has three displacable movable members.

In a particularly simple embodiment the rods are straight and mounted excentrically in the elements. Alternatively the rods are, at least in the area where they intersect, provided with a flexing, whereby they may be mounted centrally in the elements.

If the rods are straight and mounted excentrically in the elements, the elements may be identical in shape, since they are mounted in pairs at each their end of the rod with a mutual angular rotation of 90°.

BRIEF DESCRIPTION OF THE DRAWINGS

The invention will now be described in further detail with reference to the drawings, wherein.

DETAILED DESCRIPTION OF THE PREFERRED EMBODIMENTS

Figure 1:
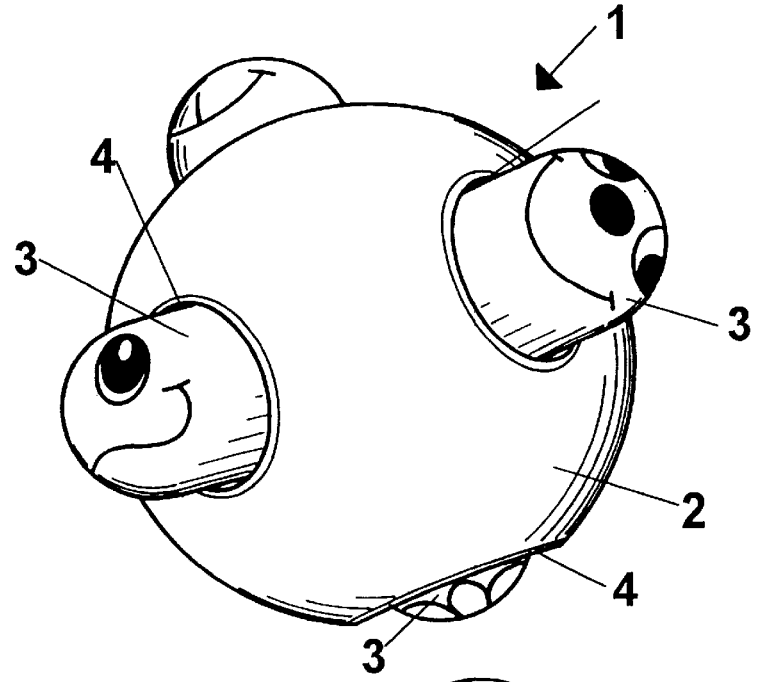
FIG. 1 illustrates a preferred embodiment of the toy element according to the invention.

FIG. 1 illustrates a preferred embodiment of the toy element 1 according to the invention.

The toy element 1 consists of a spherical body 2 with radially movable elements 3 arranged in apertures 4 in the spherical body 2. In FIG. 1, three radially movable elements 3 are illustrated which are arranged perpendicularly relative to each other. On the opposite side of the toy element 1, the preferred embodiment further features three elements 3, bringing the number of elements up to a total of six.

In order to increase the thrill experienced by the children when playing with the toy element 1, the elements 3 may be decorated as shown in FIG. 1 where each element 3 is provided with eyes and mouth. Moreover, the elements 3 may also advantageously have different colours and the spherical body 2 have a colour different from that of the elements 3.

The elements 3 have been displaceably embedded in the apertures 4 of the spherical body 2 as indicated by the different levels of expulsion of the elements 3 from the spherical body 2. Preferably, the embedding is performed in tubular members which extend perpendicularly into the hollow body 2, which is not shown in detail, however. The element 3 may be loosely embedded in such a manner that they are moved in the apertures 4 exclusively as a consequence of the movement of the toy element 1 and the influence of gravity on the elements 3. Alternatively the elements 3 may be spring-biased whereby they occupy their protruding position when unbiased and are only impelled when exposed to the weight of the toy element 1 when rolling thereacross.

Figure 2:
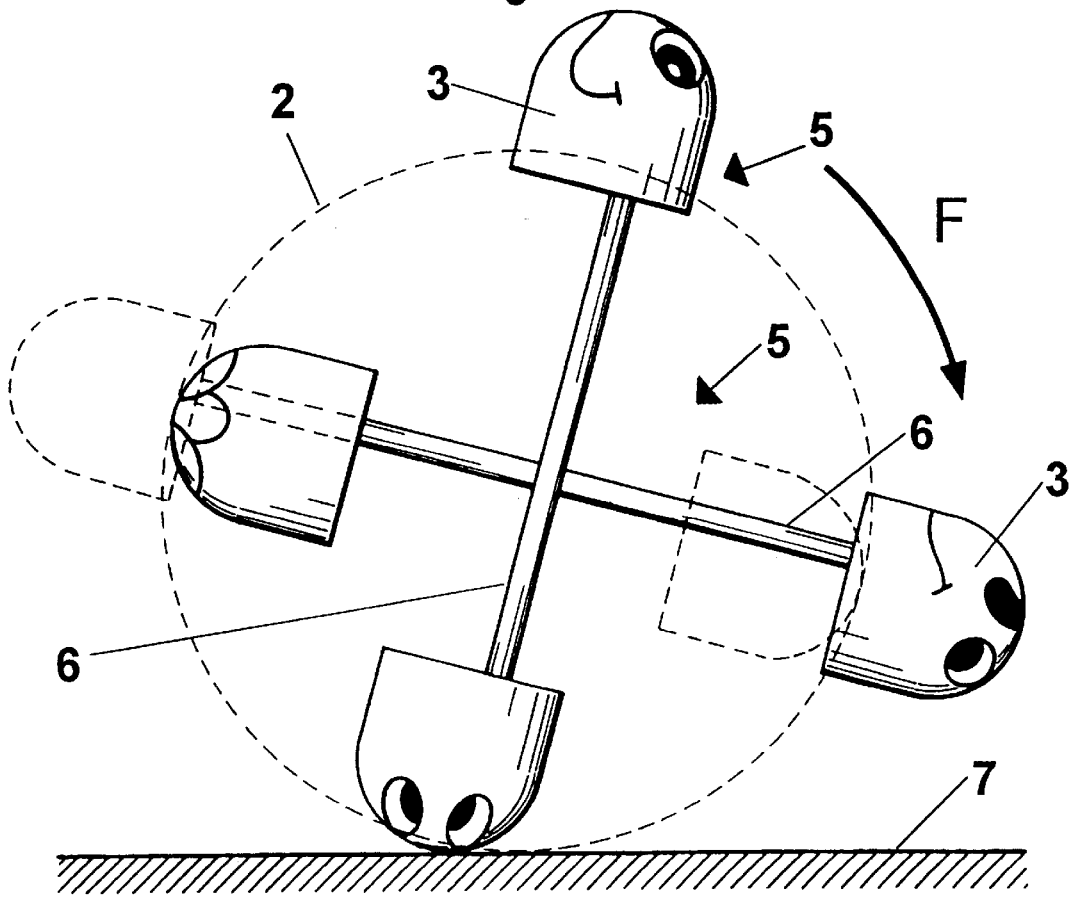
FIG. 2 is a schematical view illustrating how the elements are connected in pairs.

According to the preferred embodiment of the toy element 1 according to the invention, the radially movable elements 3 are connected in pairs which will appear from FIG. 2 where two movable members 5 are shown in intersecting state. Each movable member consists of two radially movable elements 3 and a connecting rod 6.

The spherical body 2 is marked with a dashed line and at one of the movable members 5, dashed lines indicates how it may be displaced from the fully drawn position to the dashed position. The dashed position of the movable member 5 will occur e.g. when the toy element is rolled across a floor 7 in the direction of the arrow F whereby the weight of the toy element 1 makes the movable member 5 be displaced to the dashed position.

The movable member 5 produces a certain amount of frictional resistance when displaced and therefore the toy element 1 loses some of its energy when rolling over the element 3. This means that the toy element 1 is slowed down comparatively quickly and therefore it never rolls to far away from the child playing with it. Moreover, the resistance to displacement means that the toy element 1 changes direction when rolling over the element 3 and therefore its rolling movement becomes irregularly bouncing which pleases the child.

Figure 3:
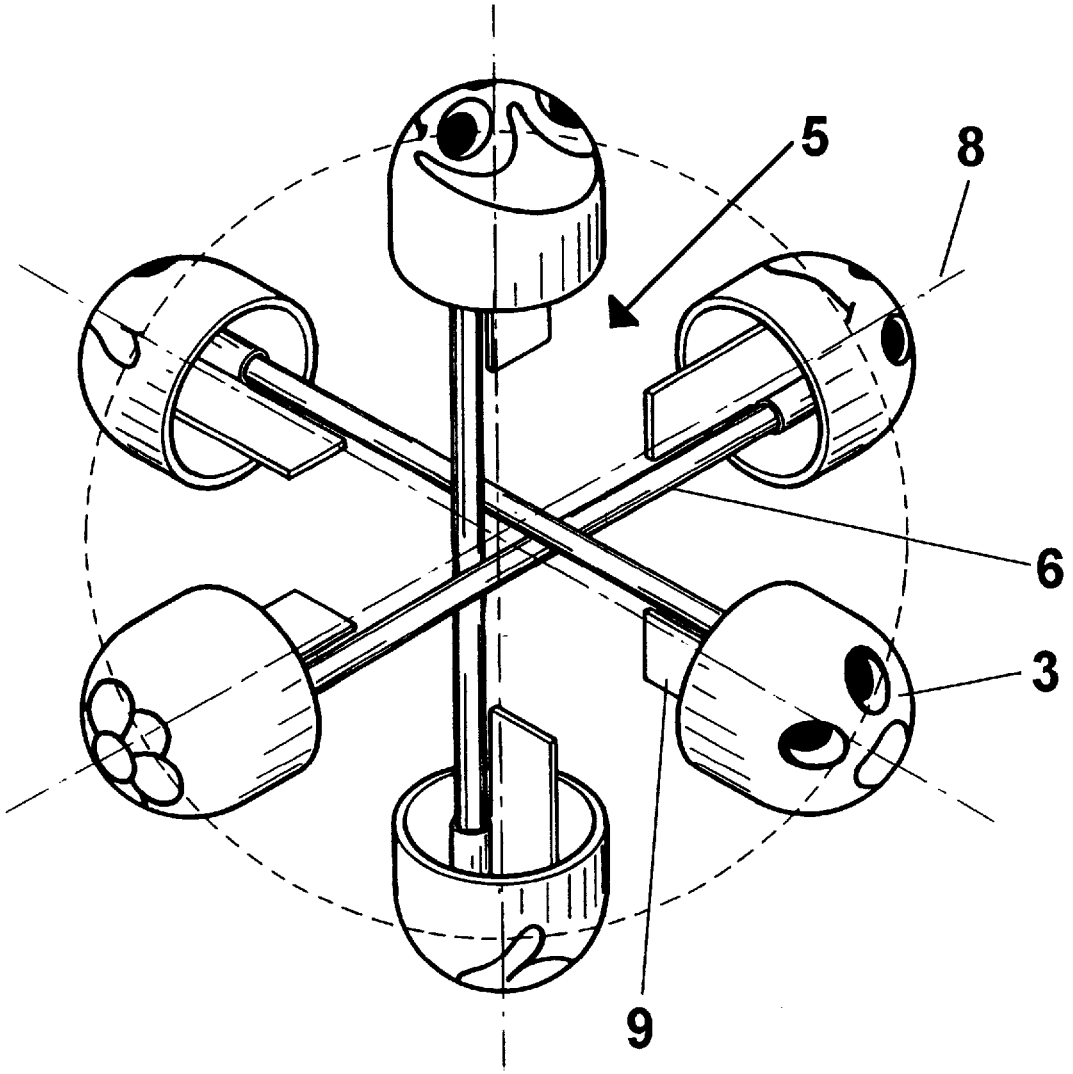
FIG. 3 illustrates the preferred embodiment of the device for use in the toy element.

FIG. 3 illustrates the preferred embodiment of a device which may be used in the toy element 1, said device showing the connection between the elements 3 in pairs and the mutual connection between the movable members 5.

As will appear the elements 3 are connected in pairs by means of a straight rod 6 mounted excentrically in the elements 3. This mounting permits the central axis of the movable members 5 to intersect in the same point, since all the rods 6 are arranged outside this point.

In order to limit the displacement of the movable members 5, each element 3 is provided with a spacer part 9 that may engage with one of the rods 6 on the other movable members 5.

In the preferred embodiment, all the rods 3 are identical as they are mounted in pairs on the rod 6 with a mutual angular displacement of 90°. Hereby the excentricity as well as the spacer parts 9 become identical seen relative to the centre of the device. By manufacturing rods as well as elements to be identical, a very simple structure of the device is obtained.

Figure 4:
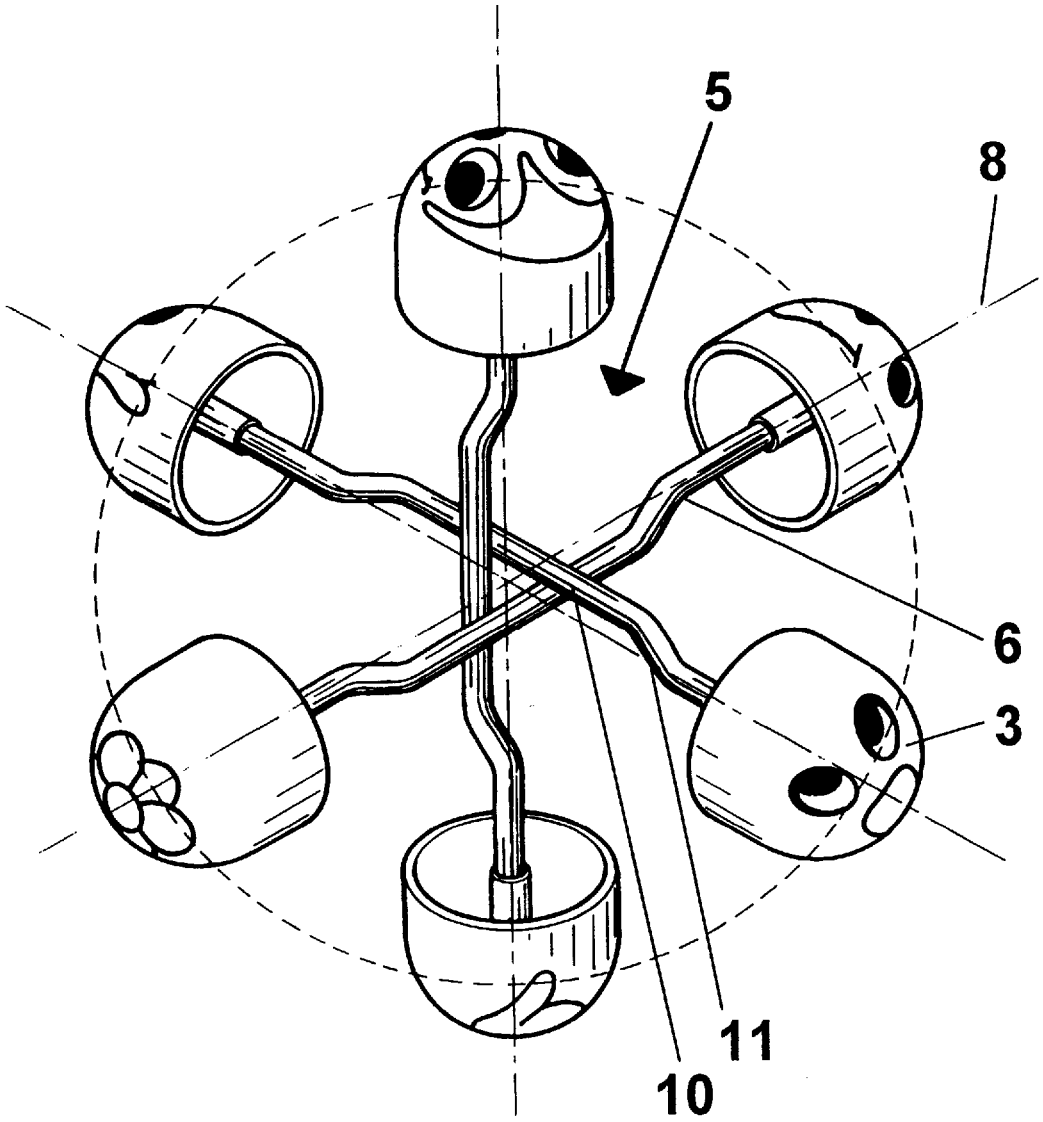
FIG. 4 illustrates an alternative embodiment of the device for use in the toy element.

An alternative embodiment of the device is illustrated in FIG. 4 which also shows three mutually intersecting movable members 5.

In this embodiment, the elements 3 are connected by rods 6 which are centrally mounted in the elements 3 and provided with a flexing 10. The flexing 10 has the same function as the excentrically mounted rods 6 shown in FIG. 3, viz. to permit the central axes 8 of the movable members 5 to intersect in the same point.

In this embodiment, the spacer parts 9 may be omitted since the flexing edge 11 may be used to delimit the displacement of the movable members 5.

Also in this embodiment, rods 6 as well as elements 3 may be manufactured to be identical. This embodiment presents the further advantage that there are no particular requirements to the orientation of the elements 3, the rods 6 being mounted centrally, optionally rotatably in the elements 3.

The preferred embodiment features three movable members which each consist of two radially movable elements 3 connected by means of a rod 6. However, there may just as well be only two or more than three movable members, the toy element 1 as well as the integral device being readily adaptable, if desired.

I claim:

1. A toy element, comprising a rolling body having a body surface, at least four apertures being provide in the body surface; and at least two members, each of said members comprising a first element opposite a second element, each of said first element and said second element being aligned with one of said apertures and being interconnected by a rigid rod, each of said members having a center line;

wherein each of said members is movable a distance within the rolling body between a first position and a second position, said first element significantly protruding from said body surface and said second element less protruding from said body surface when the corresponding member is in said first position, and said second element significantly protruding from said body surface and said first element less protruding from said body surface when the corresponding member is in said second position;

and wherein the center lines of said members intersect at a common intersection point;

and wherein each of said rods, at least over a length around said intersection point corresponding to the distance between said first and second positions, is positioned apart from said center line.

2. The toy element according to claim 1, wherein the members are freely displaceably embedded in the apertures of the body surface, and wherein movement between the first position and the second position is exclusively caused by movement of the rolling body and gravity on the members.

3. The toy element according to claim 1, wherein the rolling body is spherical, and wherein the elements protrude radially relative to the spherical rolling body.

4. The toy element according to claim 3, wherein three members are arranged perpendicularly relative to each other, and wherein the spherical rolling body is provided with six apertures.

5. The toy element according to claim 4, wherein each rod is straight and mounted eccentrically in the first element and the second element.

6. The toy element according to claim 5, wherein each of the members includes spacer parts for restricting displacement of the member by engaging with the rod of another of the members.

7. The toy element according to claim 6, wherein the spacer parts are provided at each of the first elements and the second elements, the spacer part of the first element having an identical shape as the spacer part of the second element, and wherein the first element and the second element are mounted on the rod so that the spacer part of the first element is at a rotational angle of 90 degrees relative to the spacer part of the second element.

8. The toy element according to claim 4, wherein each of the rods is centrally mounted in the first element and the second element, and wherein each of the rods has flexing portion traversing the intersection point.

* * * * *